US011745770B2

(12) United States Patent
Messaoud et al.

(10) Patent No.: US 11,745,770 B2
(45) Date of Patent: Sep. 5, 2023

(54) DEVICE AND METHOD FOR SUPPORTING AND GUIDING A HAULING CABLE OF A VEHICLE TRANSPORTATION INSTALLATION BY CABLE

(71) Applicant: POMA, Voreppe (FR)

(72) Inventors: Salah Messaoud, Brézins (FR); Sylvain Valayer, Charavines (FR); Stéphane Coudurier, Grenoble (FR)

(73) Assignee: POMA, Voreepe (FR)

( * ) Notice: Subject to any disclaimer, the term of this patent is extended or adjusted under 35 U.S.C. 154(b) by 392 days.

(21) Appl. No.: 16/984,501

(22) Filed: Aug. 4, 2020

(65) Prior Publication Data

US 2021/0086799 A1 Mar. 25, 2021

(30) Foreign Application Priority Data

Sep. 20, 2019 (FR) ..... 1910423

(51) Int. Cl.
*B61B 12/02* (2006.01)

(52) U.S. Cl.
CPC ..... *B61B 12/02* (2013.01)

(58) Field of Classification Search
CPC ..... B61B 12/007; B61B 12/02; B61B 12/026; B61B 12/06; B61B 12/10; B61B 12/12; B61B 12/122
See application file for complete search history.

(56) References Cited

U.S. PATENT DOCUMENTS 4,462,314 A 7/1984 Kunczynski
2009/0057632 A1* 3/2009 Bonifat ..... B61B 12/02 254/390

FOREIGN PATENT DOCUMENTS

| | | | |
|---|---|---|---|
| FR | 2838697 | A1 | 10/2003 |
| FR | 2920385 | A1 | 3/2009 |
| FR | 3074467 | A1 | 6/2019 |
| WO | 2016/012929 | A1 | 1/2016 |

* cited by examiner

*Primary Examiner* — Robert J McCarry, Jr.
(74) *Attorney, Agent, or Firm* — Oliff PLC

(57) ABSTRACT

Device for supporting and guiding a hauling cable of a vehicle transportation installation by cable, including a sheave configured for supporting and guiding the hauling cable, a first girder provided with a main axis, a second girder supporting the sheave and mounted pivotally movable around the main axis, at least one recovery element mounted on the first girder, and at least one cooperating element mounted on the second girder at a distance from said at least one recovery element in a normal operating state where the second girder swivels around the main axis, and configured to be in contact with said at least one recovery element in an abnormal operating state corresponding to failure of the main axis.

15 Claims, 13 Drawing Sheets

DEVICE AND METHOD FOR SUPPORTING AND GUIDING A HAULING CABLE OF A VEHICLE TRANSPORTATION INSTALLATION BY CABLE

BACKGROUND OF THE INVENTION

The invention relates to supporting and guiding a hauling cable of a vehicle transportation installation by cable, and more particularly to supporting and guiding an aerial hauling cable.

STATE OF THE ART

At the present time, transportation installations by means of vehicle hauling cables are equipped with support and guiding devices such as sheave assemblies to support and guide the hauling cables moving between the passenger loading and unloading stations. Generally speaking, the sheave assemblies are supported by towers and are equipped with rotating sheaves on which the hauling cable presses. The sheaves are mounted rotating freely on articulated girders to keep the hauling cable pressing on the tower when variations of the cable bow occur due to the weight of the vehicle and to running of the vehicle clamp over the sheaves.

French Patent application FR2920385, filed in the name of the applicant, can be cited disclosing a mechanical adjustment device of a supporting and guiding sheave assembly of an aerial cable of a mechanical lift installation. The sheave assembly comprises cable guide sheaves mounted rotating on a support frame according to parallel rotation axes located staggered along the support frame.

In general manner, an axis, which is an elongate part, serves the purpose of rotationally or pivotally articulating a movable element with respect to a movable or fixed support on which the axis is mounted in fixed manner. The rotation axis is an important part of the sheave assembly and may be subject to failure, such as wear or, in exceptional situations, breaking. Breaking of the axis would result in all the elements composing the sheave assembly collapsing.

Sheave assemblies are complex elements and therefore have to be inspected regularly to check their condition. In particular, it may be necessary to dismantle a sheave assembly to perform a precise inspection of the parts which may be worn and have to be replaced, in particular the rotation axes. Dismantling a sheave assembly is a long and delicate operation.

French Patent application FR 3074467, filed in the name of the applicant, can also be cited disclosing a device for supporting and guiding a hauling cable, comprising a hollow axis to articulate a girder with respect to a support structure of the supporting and guiding device and to enable the inside of the axis to be inspected without having to dismantle the supporting and guiding device. But in the event of breaking of the axis, the articulated girder is no longer supported by the support structure and may fall resulting in collapsing of all the elements supported by the girder.

SUMMARY OF THE INVENTION

One object of the invention consists in remedying these shortcomings, and more particularly in providing means for supporting and guiding that avoid having to dismantle the elements of a supporting and guiding device to inspect the state of wear of the rotation axes of the device.

Another object consists in providing a means for securing supporting and guiding of a hauling cable of a vehicle transportation installation.

According to one feature of the invention, a device for supporting and guiding a hauling cable of a vehicle transportation installation by cable is proposed comprising a sheave configured for supporting and guiding the hauling cable, a first girder provided with a main axis, and a second girder supporting the sheave and mounted pivotally movable around the main axis.

The device comprises at least one recovery element mounted on the first girder and configured to catch hold of the second girder in an abnormal operating state corresponding to failure of the main axis, and at least one cooperating element mounted on the second girder at a distance from said at least one recovery element in a normal operating state where the second girder swivels around the main axis, said at least one cooperating element being configured to be in contact with said at least one recovery element in the abnormal operating state.

A supporting and guiding device is thus provided equipped with elements configured to catch hold of a pivotally movable girder in the event of failure of the main axis. In other words, the elements of the device prevent the movable girder from falling in the exceptional case of breaking of the main axis. Such elements enable inspection of the main axis to check its operating state to be limited. The elements thereby limit operations involving disassembly of the sheave assembly.

Said at least one recovery element and said at least one cooperating element can be shaped so as to allow swivelling of the second girder in the abnormal operating state.

Advantageously, a device is provided that allows swivelling of the girders even in case of breaking of a main axis. The installation can then continue to be operated for a certain time before performing the repair operations to change the damaged parts of the sheave assembly.

According to one embodiment, said at least one cooperating element corresponds to a cooperating part mounted salient from the second girder and said at least one recovery element corresponds to a recovery housing formed on the first girder and configured to receive the cooperating part in the abnormal operating state.

According to another embodiment, said at least one cooperating element corresponds to a cooperating housing formed on the second girder and said at least one recovery element corresponds to a recovery part mounted salient from the first girder and configured to be inserted in the cooperating housing in the abnormal operating state.

According to another embodiment, the first girder can comprise two external flanges and the second girder is situated between the two external flanges.

According to yet another embodiment, the first girder comprises two external flanges delimiting an inner space between the two external flanges, and the second girder is situated outside the inner space.

The main axis can be hollow.

Advantageously, the second girder can be provided with two stop screws and a rotation axis, the sheave is mounted movable in rotation around the rotation axis, and the two stop screws are shaped so as to allow rotation of the sheave around the rotation axis in the normal operating state and to be in contact with the sheave in a broken state corresponding to breaking of the rotation axis.

According to another feature of the invention, a method for supporting and guiding a hauling cable of a vehicle transportation installation by cable is proposed, the installation comprising a sheave configured for supporting and guiding the hauling cable, a first girder provided with a main axis, and a second girder supporting the sheave and mounted pivotally movable around the main axis, the method comprising swivelling of the second girder around the main axis in a normal operating state.

In the method, at least one recovery element is mounted on the first girder and at least one cooperating element is mounted on the second girder at a distance from said at least one recovery element in the normal operating state, and said at least one cooperating element comes into contact with said at least one recovery element in an abnormal operating state corresponding to failure of the main axis.

DESCRIPTION OF THE DRAWINGS

Other advantages and features will become more clearly apparent from the following description of particular embodiments and implementation modes of the invention given for non-restrictive example purposes only and represented in the appended drawings, in which.

DETAILED DESCRIPTION

Figure 1:
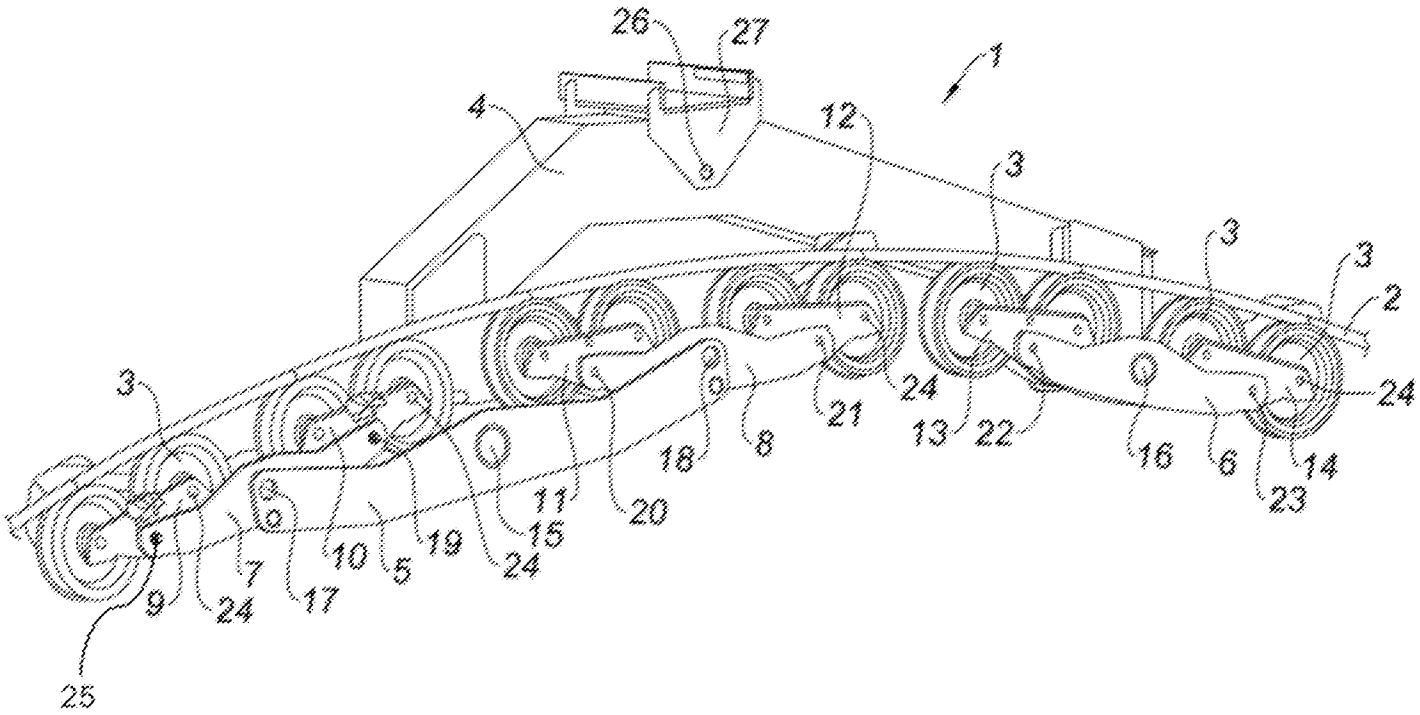
FIG. 1 schematically illustrates a right-hand side perspective view of an embodiment of a supporting and guiding device according to the invention.

In FIGS. 1 to 18, a device 1 for supporting and guiding a hauling cable 2 of a vehicle transportation installation by cable has been represented. The vehicle or vehicles as well as the installation are not represented for the sake of simplification.

In general manner, device 1 comprises at least one sheave 3 and at least two girders 4 to 14. Device 1 is designed to support hauling cable 2, more particularly device 1 provides a support and a guide for the cable 2. Hauling cable 2 rests on sheaves 3 which are configured for supporting and guiding the hauling cable 2. Girders 4 to 14 each comprise at least one axis 15 to 25. The installation further comprises a fixed support structure 27 and girders 4 to 14 are articulated with respect to support structure 27. A first set of axes 15 to 23 and 25, called main axes, enable girders 4 to 14 to be articulated on one another and with respect to support structure 27. Main axes 15 to 23 and 25 can be solid or hollow. A second set of axes 24, noted rotation axes, enable sheaves 3 to be articulated on a girder 9 to 14. In other words, sheaves 3 are mounted movable in rotation respectively around rotation axes 24. Preferentially, rotation axes 24 are mounted in fixed manner on girders 9 to 14.

In general manner, device 1 comprises at least one girder 4 to 8, called primary girder, equipped with at least one main axis 15 to 23 and 25. Device 1 further comprises at least one girder 9 to 14, called secondary girder, supporting at least one sheave 3. A secondary girder 9 to 14 is mounted pivotally movable around a main axis 19 to 23 and 25 mounted on a primary girder 6 to 8. Primary girders 4 to 8 can further be mounted in fixed manner on support structure 27 or be mounted pivotally movable around other main axes 15 to 18. Preferably, main axes 15 to 23 and 25 are mounted in fixed manner on primary girders 4 to 8 and rotation axes 24 are mounted in fixed manner on secondary girders 9 to 14. A specific primary girder 4 is also called support girder as it is mounted pivotally movable around a support axis 26. Support axis 26 is mounted in fixed manner on support structure 27.

Figure 2:
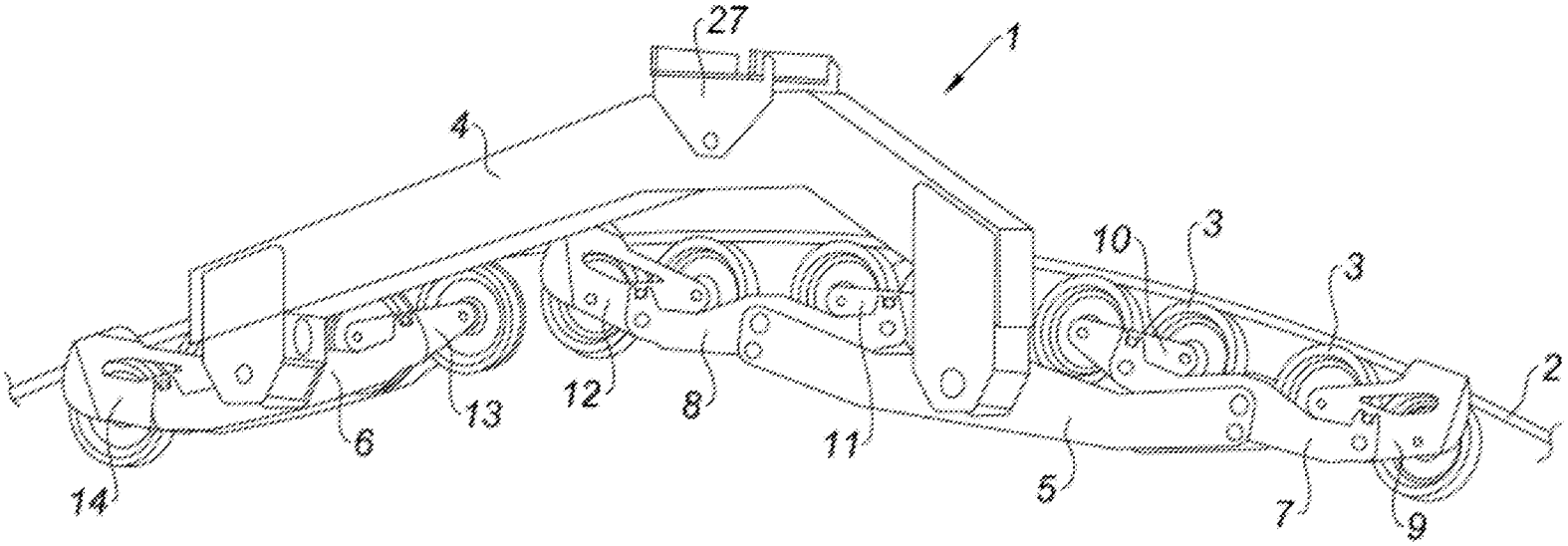
FIG. 2 schematically illustrates a left-hand side perspective view of the supporting and guiding device of FIG. 1.

For example, as illustrated in FIGS. 1 and 2, device 1 comprises twelve sheaves 3. Device 1 comprises eleven girders 4 to 14, ten main axes 15 to 23 and 25, and twelve rotation axes 24, represented in FIG. 1. In the example illustrated in FIGS. 1 and 2, first primary girder 4 comprises two main axes 15, 16 around which a second primary girder 5 and a third primary girder 6 are respectively mounted in pivotally movable manner. Second primary girder 5 comprises two main axes 17, 18 around which a fourth primary girder 7 and a fifth primary girder 8 are respectively mounted in pivotally movable manner. Fourth primary girder 7 comprises two main axes 19 and 25 around which a first secondary girder 10 and a second secondary girder 9 are respectively mounted in pivotally movable manner.

Fifth primary girder 8 comprises two main axes 20, 21 around which a third secondary girder 11 and a fourth secondary girder 12 are respectively mounted in pivotally movable manner.

Third primary girder 6 comprises two main axes 22, 23 around which a fifth secondary girder 13 and a sixth secondary girder 14 are respectively mounted in pivotally movable manner.

In general manner, sheaves 3 are mounted movable in rotation respectively around rotation axes 24 and girders 4 to 14 are mounted pivotally movable with respect to one another. What is meant by "mounted movable in rotation" is an element that is able to accomplish one or more full rotations around an axis. What is meant by "mounted pivotally movable" is an element that is able to accomplish a part of a rotation through less than 360° in one direction of rotation or the other.

More particularly, device 1 comprises at least one recovery element 30 to 39 and at least one cooperating element 40 to 47. A recovery element 30 to 39 is designed to cooperate with a cooperating element 40 to 47 in an abnormal operating state of the device in order to guarantee support and guiding of the hauling cable. An abnormal operating state of device 1 corresponds to wear, or even exceptionally breaking, of a main axis 15 to 23 and 25. In general manner, at least one recovery element 30 to 39 is mounted on a first girder and at least one cooperating element 40 to 47 is mounted on a second girder. In particular, a cooperating element 40 to 47 is mounted at a distance from a recovery element 30 to 39 in a normal operating state of device 1. In other words, cooperating element 30 to 39 is not in contact with a recovery element in the normal operating state. What is meant by normal operating state is the situation where the second girder swivels around main axis 15 to 23 and 25 mounted on the first girder. More particularly, recovery element 30 to 39 is configured to catch hold of the second girder and cooperating element 40 to 47 is configured to come into contact with recovery element 30 to 39 in the abnormal operating state.

Advantageously, a recovery element 30 to 39 and a cooperating element 40 to 47 are shaped so as to allow swivelling of the second girder in the abnormal operating state. Thus, when cooperating element 40 to 47 comes into contact with the recovery element 30 to 39, the second girder can still swivel and guarantee the function of support and guiding of device 1. In other words, in the abnormal operating state, the second girder is moved by pressing of hauling cable 2 and cooperating element 40 to 47 moves towards recovery element 30 to 39. In a limit situation of the abnormal operating state, cooperating element 40 to 47 comes into contact with recovery element 30 to 39.

For example, a cooperating element 40 to 47 can be a cooperating part 40, 44, 45, 46, 47 mounted salient from the second girder and recovery element 30 to 39 corresponds to a recovery housing 30, 34 formed on the first girder and configured to receive cooperating part 40, 44, 45, 46, 47 in the abnormal operating state.

As a variant, cooperating element 40 to 47 corresponds to a cooperating housing 41, 42, 43 formed on the second girder and recovery element 30 to 39 corresponds to a recovery part 31, 32, 33, 35 to 39 mounted salient from the first girder and configured to be inserted in cooperating housing 41, 42, 43 in the abnormal operating state.

Figure 3:
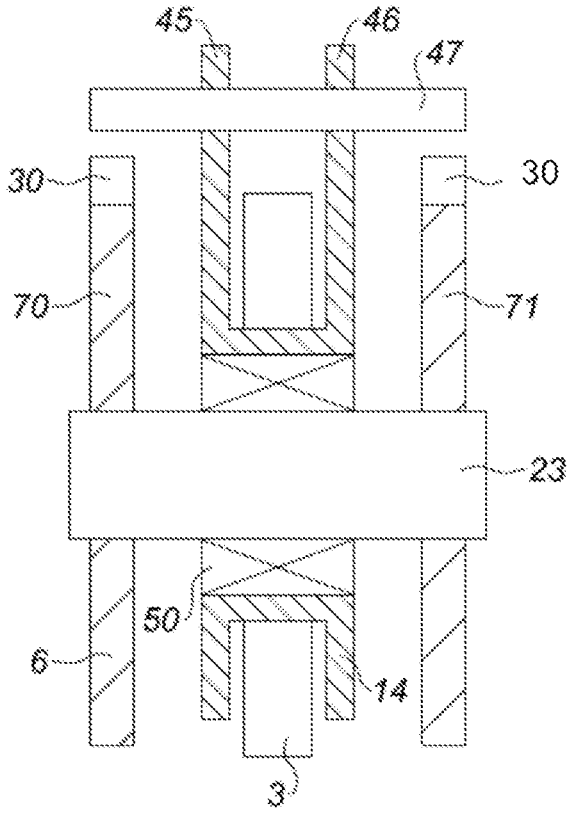
FIG. 3 schematically illustrates a cross-sectional view of another embodiment of a supporting and guiding device.

In FIG. 3, an embodiment has been represented wherein first girder 6 comprises two external flanges 70, 71 and second girder 14 is located between the two external flanges 70, 71. This configuration of girders 6, 14 is also referred to as clevis configuration. In this configuration, second girder 14 is mounted swivelling on main axis 23 by means of a bearing 50. In this embodiment, cooperating element 47 is a cylindrical axis, for example a tube or a solid rod, and first girder 6 comprises two recovery elements 30 corresponding to two housings respectively formed on the two external flanges 70, 71.

Figure 4:
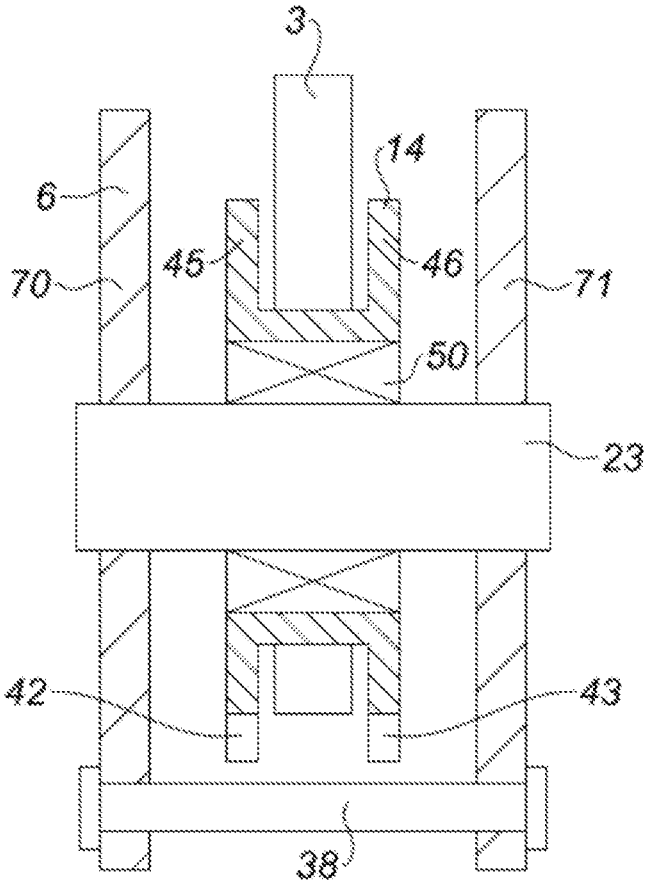
FIG. 4 schematically illustrates a cross-sectional view of another embodiment of a supporting and guiding device.
Figure 5:
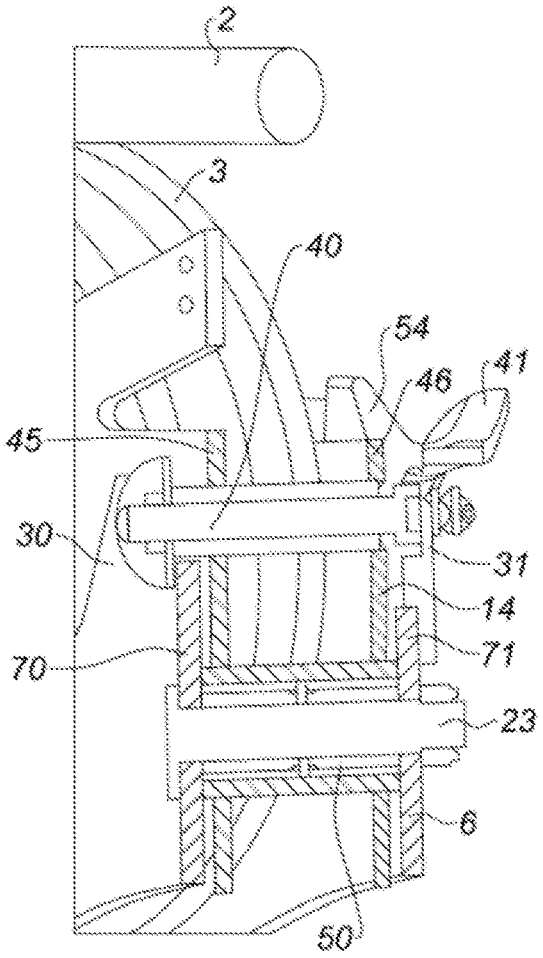
FIG. 5 schematically illustrates a cross-sectional perspective view of another embodiment of a supporting and guiding device.
Figure 6:
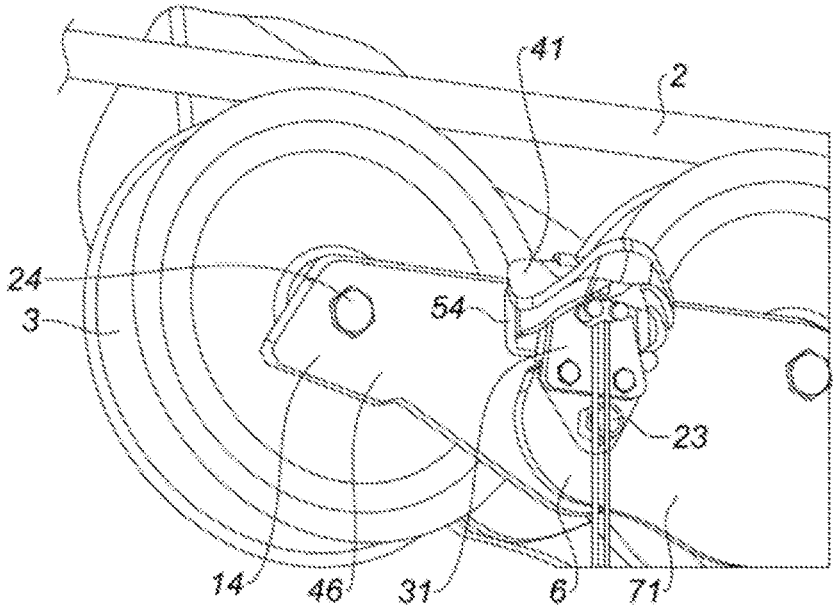
FIG. 6 schematically illustrates a left-hand side perspective view of the supporting and guiding device of FIG. 5.
Figure 7:
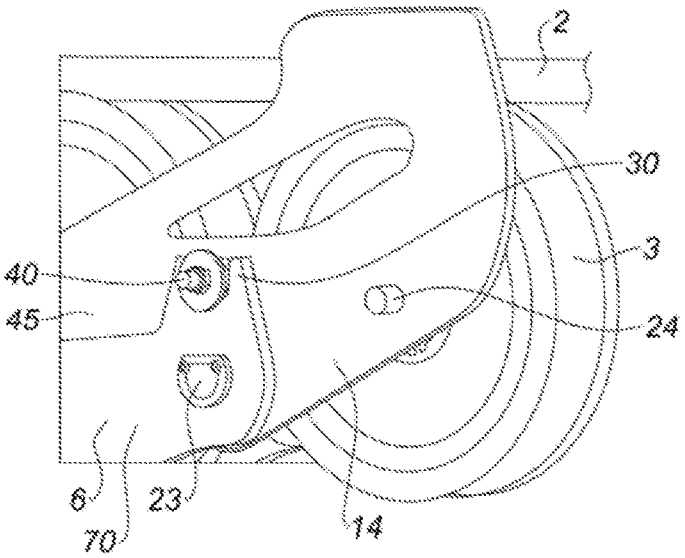
FIG. 7 schematically illustrates a right-hand side perspective view of the supporting and guiding device of FIG. 5.
Figure 8:
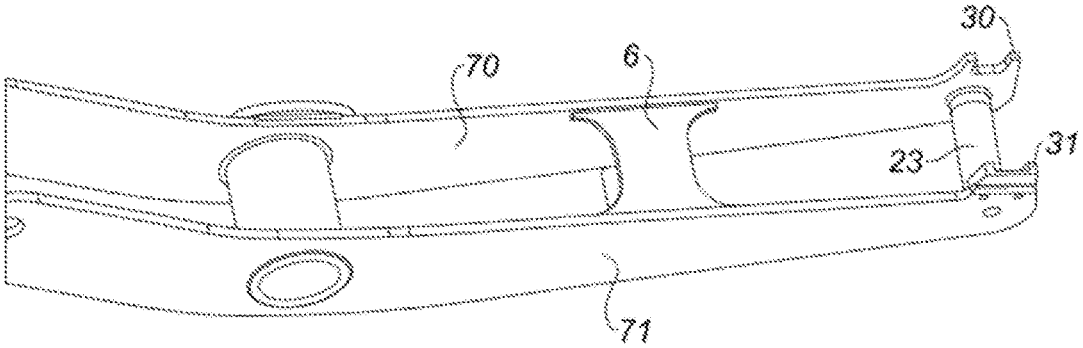
FIG. 8 schematically illustrates a top perspective view of the supporting and guiding device of FIG. 5.
Figure 9:
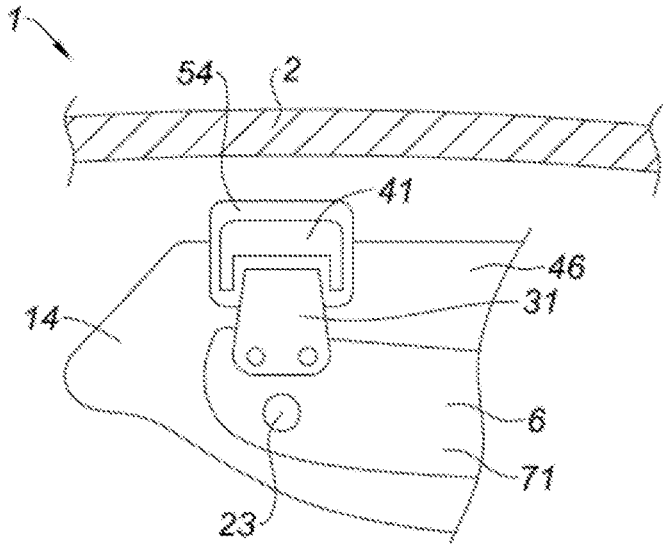
FIG. 9 schematically illustrates a left-hand side view of a detail of the supporting and guiding device of FIG. 5.
Figure 10:
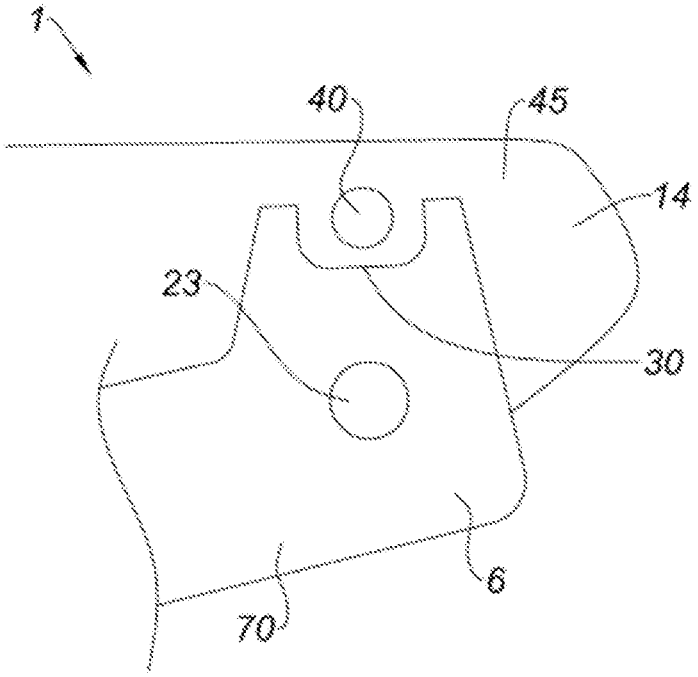
FIG. 10 schematically illustrates a right-hand side view of another detail of the supporting and guiding device of FIG. 5.

In FIG. 4, girders 6 and 14 are also in a clevis configuration. Second girder 14 comprises two cooperating elements 42, 43 corresponding to two housings respectively formed on two flanges 45, 46 of second girder 14. Recovery element 38 is a cylindrical axis, for example a tube or a solid rod.

In FIGS. 5 to 10, a preferred embodiment has been represented wherein a first girder 6 and a second girder 14 are also in a clevis configuration. In this preferred embodiment, device 1 comprises a first cooperating element 40 and a second cooperating element 41 respectively mounted on the two flanges 45, 46 of second girder 14. First cooperating element 40 is a cylindrical axis, for example a tube or a solid rod. Second cooperating element 41 is a housing. Furthermore, first girder 6 comprises a first recovery element 30 and a second recovery element 31 respectively mounted on the two external flanges 70, 71. First recovery element 30 is a housing and second recovery element 31 is a recovery part 31 mounted salient from first girder 6. Furthermore, second cooperating element 41 is a housing formed on a support plate 54 mounted on flange 46 of second girder 14.

Figure 11:
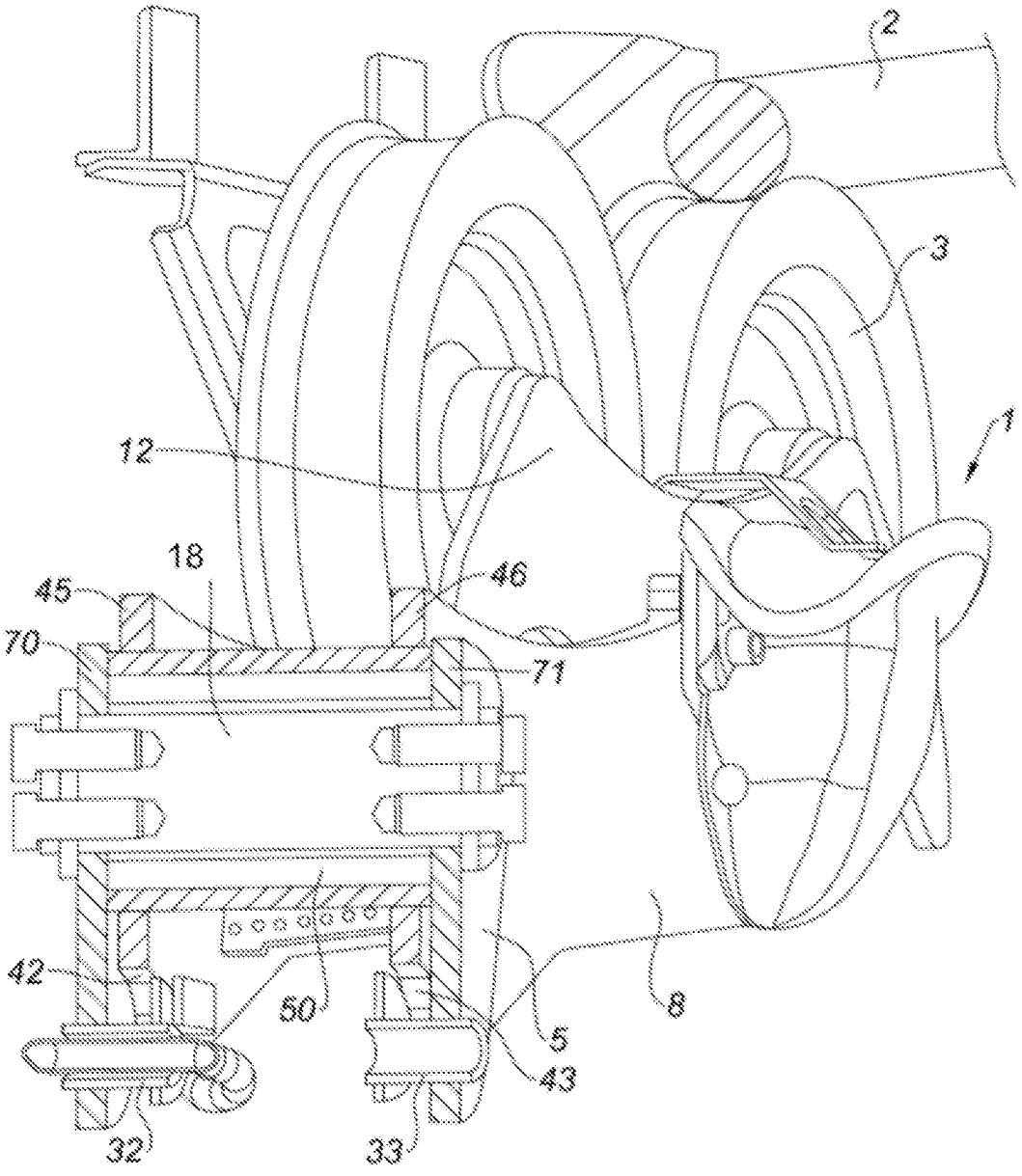
FIG. 11 schematically illustrates a cross-sectional and perspective view of an embodiment of a supporting and guiding device of hauling cable support type.
Figure 12:
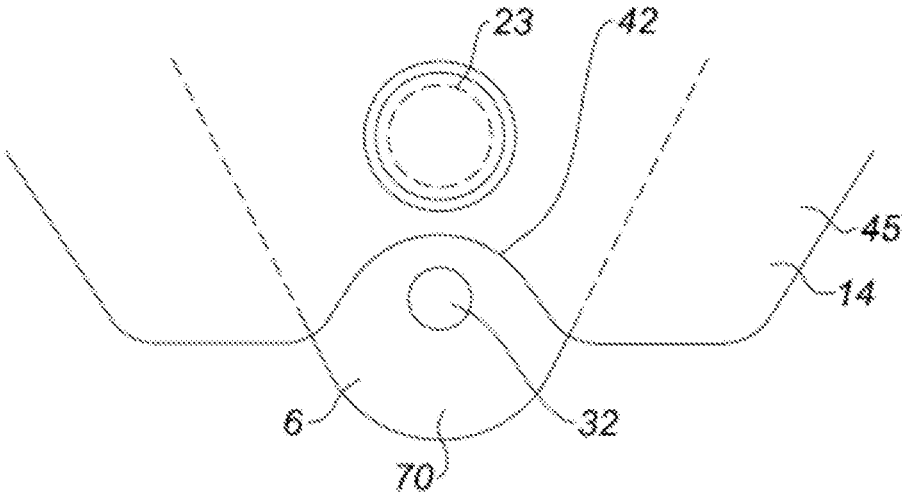
FIG. 12 schematically illustrates a right-hand side view of the supporting and guiding device of FIG. 11.

In FIGS. 11 and 12, another embodiment has been represented wherein first and second girders 5, 8 are also in clevis configuration. In this embodiment, supporting and guiding device 1 is of support type of hauling cable 2. Device 1 further comprises a first cooperating element 42 and a second cooperating element 42 respectively mounted on the two flanges 45, 46 of second girder 8. The two cooperating elements 42, 43 are housings. First girder 5 further comprises a first recovery element 32 and a second recovery element 33 respectively mounted on the two external flanges 70, 71. The two recovery elements 32, 33 are two cylindrical axes, for example two tubes or two solid rods.

Figure 13:
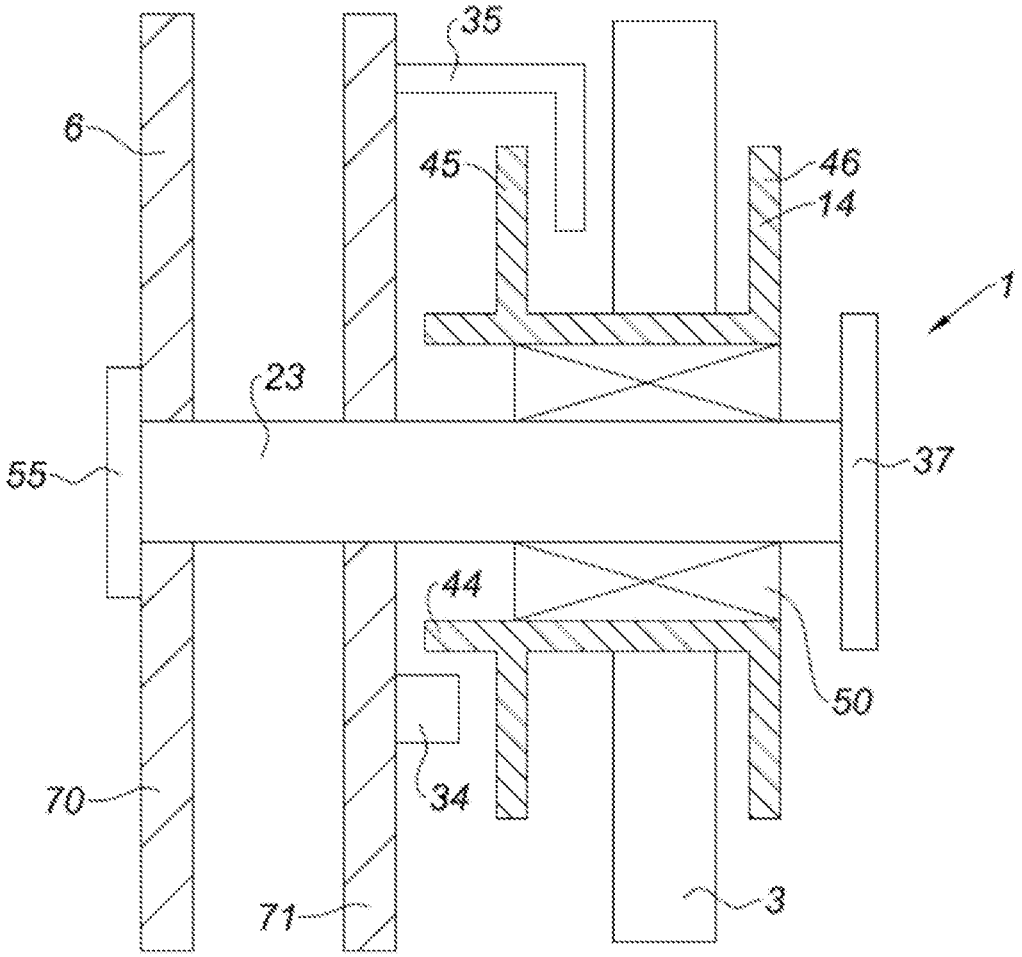
FIG. 13 schematically illustrates a cross-sectional view of yet another embodiment of a supporting and guiding device.
Figure 14:
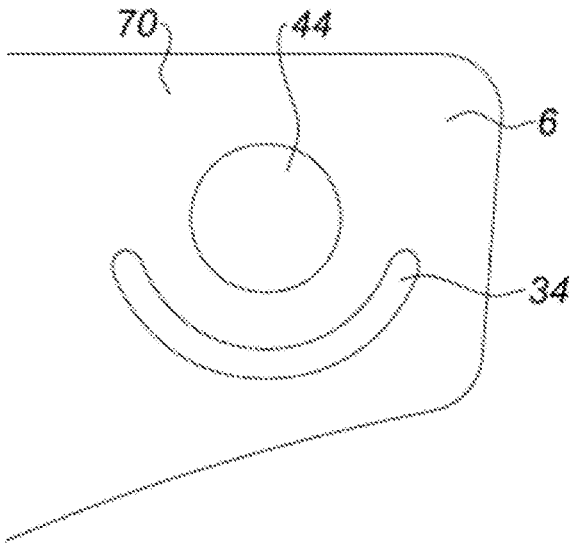
FIG. 14 schematically illustrates a right-hand side view of the supporting and guiding device of FIG. 13.

In FIGS. 13 and 14, an embodiment has been represented wherein first girder 6 comprises two external flanges 70, 71 delimiting an inner space between the two external flanges 70, 71, and second girder 14 is located outside the inner space. This configuration of girders 6, 14 is also referred to as cantilever configuration. In this configuration, second girder 14 is pivotally mounted on main axis 23 by means of a bearing 50. Main axis 23 is securedly held on first girder by a fixing stop 55. In this embodiment, device 1 comprises a first cooperating element 44 corresponding to an extension 44 of second girder 14 along main axis 23, and a second cooperating element 45 corresponding to a first flange of second girder 14. Device 1 further comprises a first recovery element 34 corresponding to a lug 34 mounted salient from an external flange 71 of first girder 6. Lug 34 forms a housing designed to receive extension 44 of second girder 14. Device 1 also comprises a second recovery element 35 corresponding to a part in the shape of a hand mounted salient from the external flange 71 to catch hold of first flange 45 of second girder. Advantageously, device 1 comprises a third recovery element 37 corresponding to an additional stop mounted on main axis 23 opposite fixing stop 55, and a third cooperating element 46 corresponding to second flange 46 of second girder 14.

Figure 15:
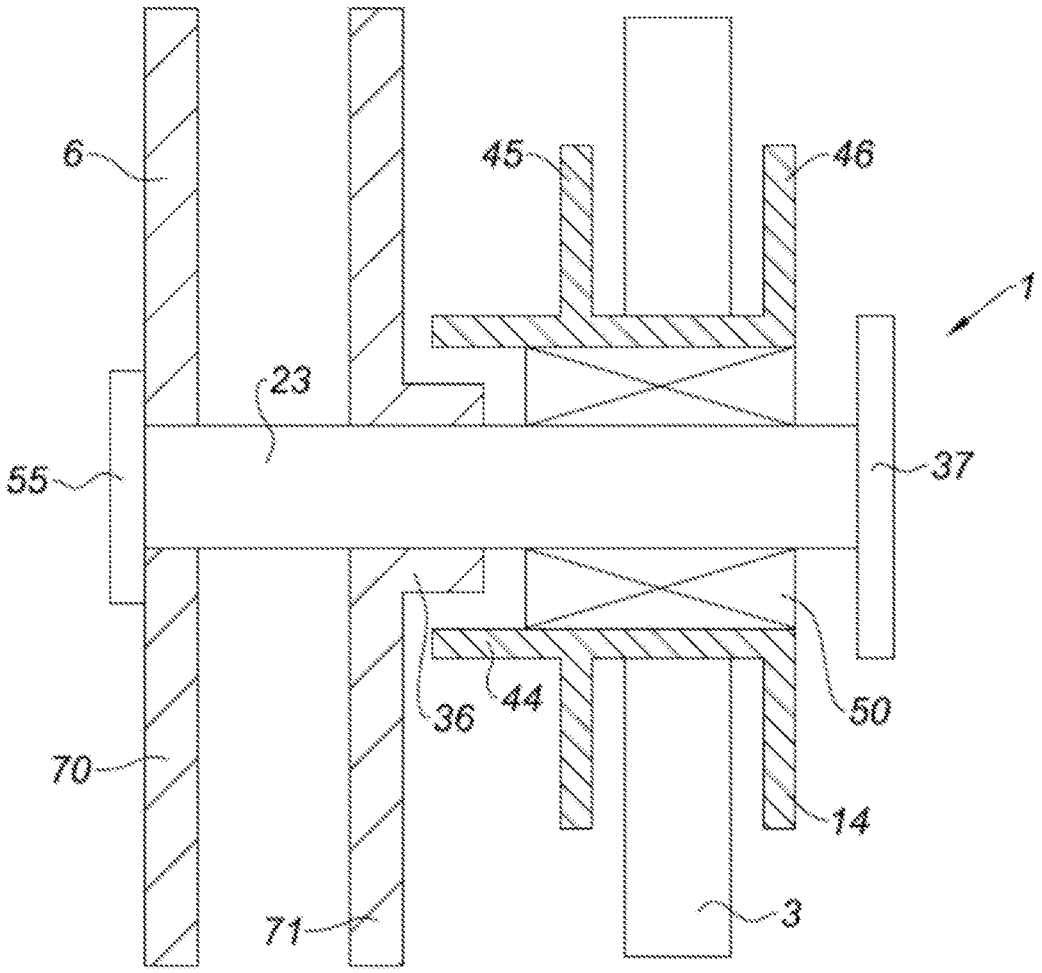
FIG. 15 schematically illustrates a cross-sectional view of another embodiment of a supporting and guiding device.

In FIG. 15, another embodiment has been represented wherein girders 6 and 14 are in cantilever configuration. Device 1 comprises a first cooperating element 44 corresponding to an extension 44 of second girder 14 along main axis 23, and a second cooperating element 46 corresponding to a second flange of second girder 14. Device 1 further comprises a first recovery element 36 corresponding to an extension 36 of first girder 6 along main axis 23, and a second recovery element 37 corresponding to an additional stop mounted on main axis 23, opposite fixing stop 55. There is an overlap distance between the two extensions 36 and 44 to catch hold of the second girder in the abnormal operating state.

Figure 16:
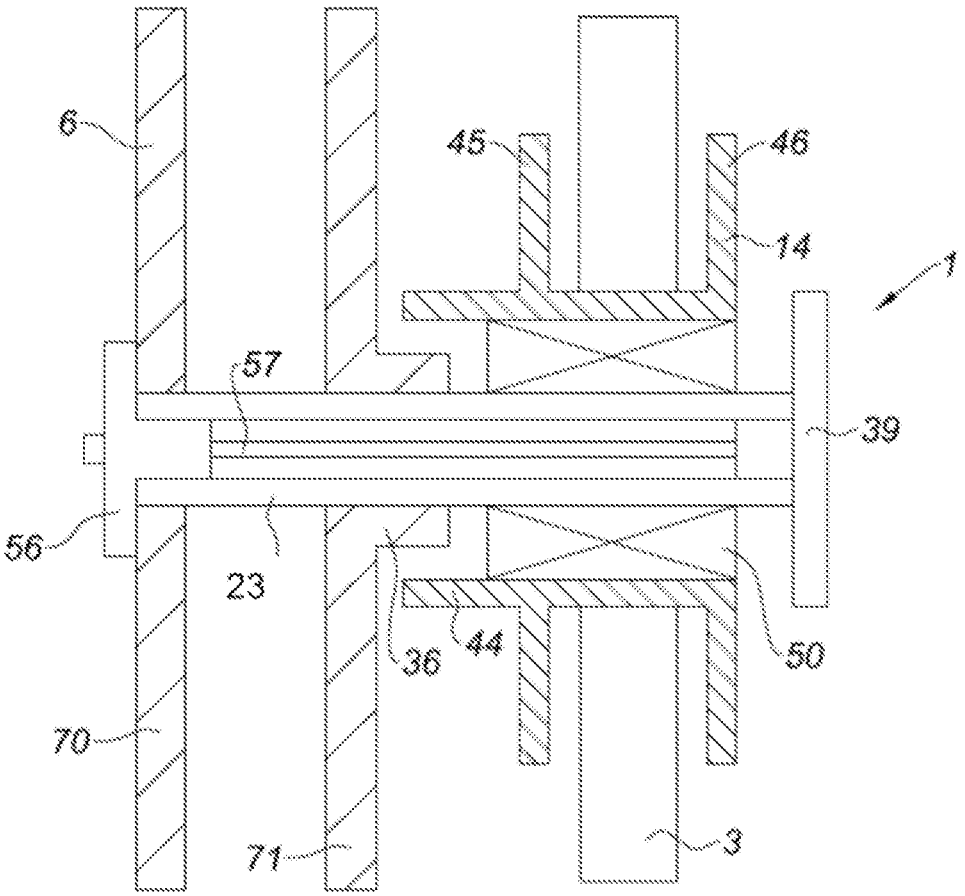
FIG. 16 schematically illustrates a cross-sectional view of another embodiment of a supporting and guiding device.

In FIG. 16, a variant of FIG. 15 has been represented wherein main axis 23 is hollow. Device 1 comprises a screw 57 that passes through the hollow of main axis 23 and connects two stops 56, 39 mounted on the two ends of main axis 23. Second stop 39 can correspond to a second recovery element of device 1 that can cooperate with second flange 46 of second girder 14.

Figure 17:
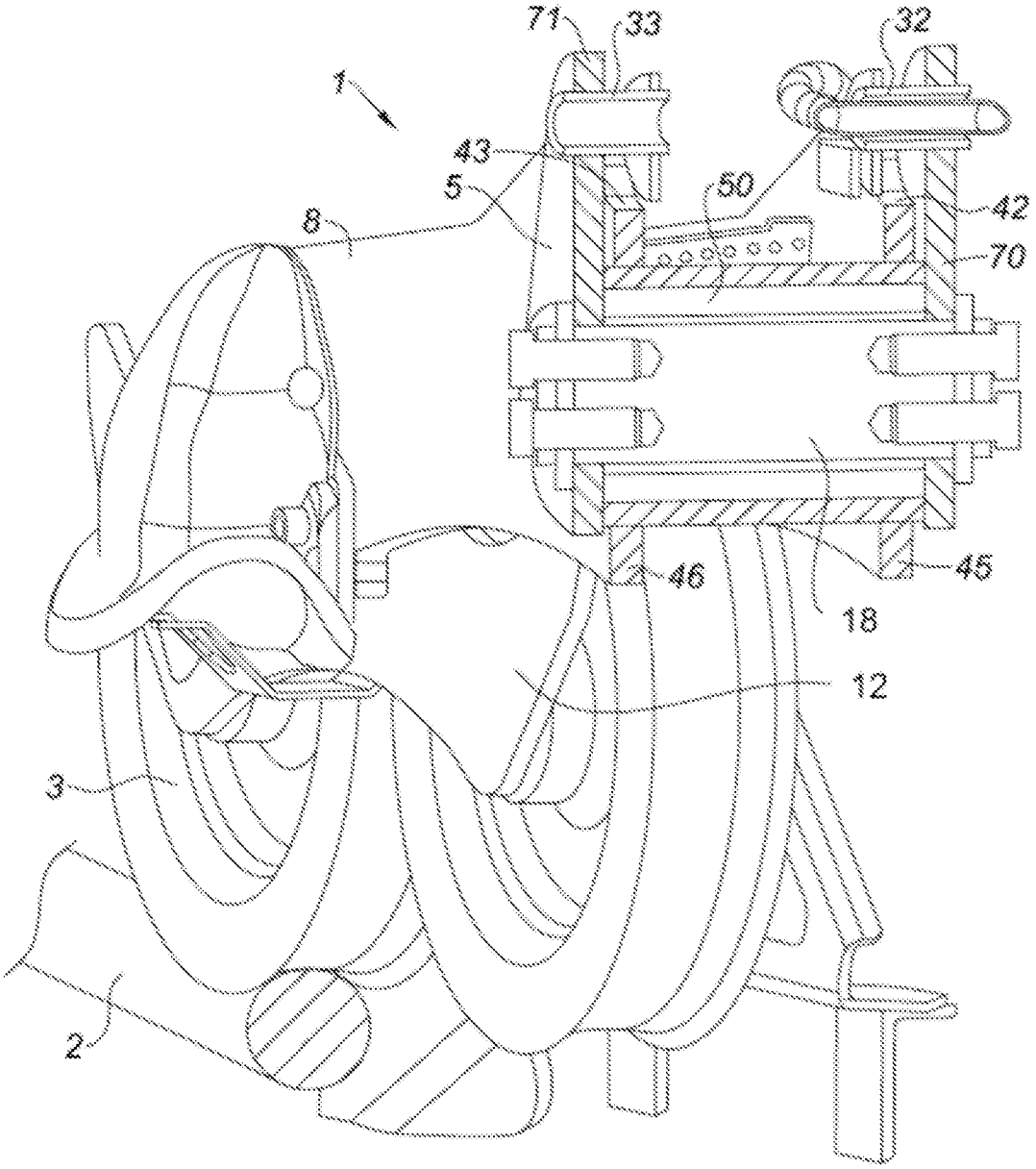
FIG. 17 schematically illustrates a cross-sectional and perspective view of an embodiment of a supporting and guiding device of hauling cable compression type.

In FIG. 17, another embodiment of device 1 of FIG. 11 has been represented in the case where device 1 is of the compression type of hauling cable 2.

Figure 18:
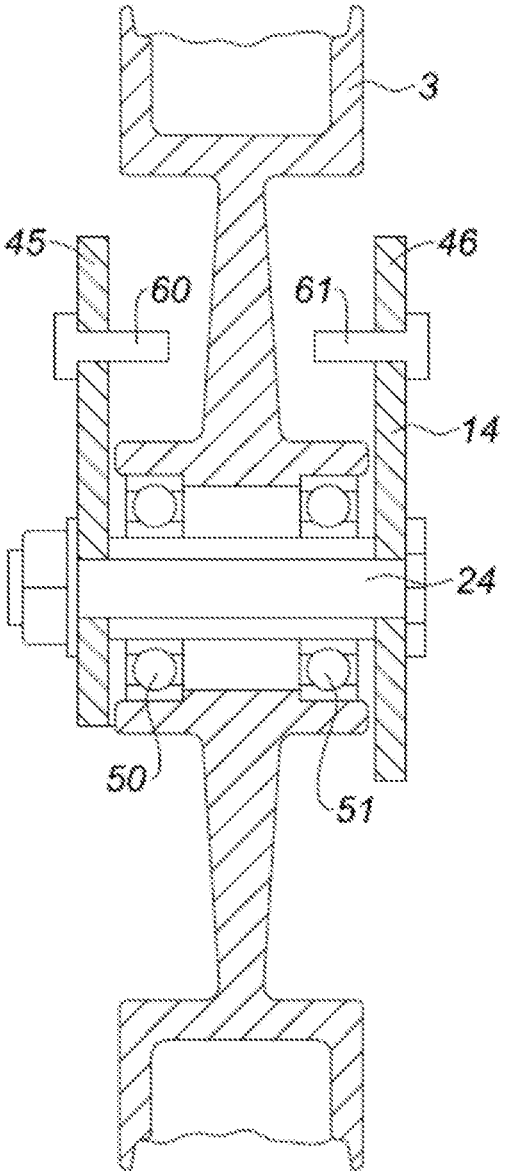
FIG. 18 schematically illustrates a cross-sectional view of another embodiment of a supporting and guiding device.

In FIG. 18, an embodiment of has been represented wherein second girder 14 is provided with two stop screws 60, 61 and a rotation axis 24. Sheave 3 is mounted movable in rotation around rotation axis 24 by means of two bearings 50, 51. The two stop screws 60, 61 are shaped so as to allow rotation of sheave 3 around rotation axis 24 in the normal operating state and to be in contact with sheave 3 in a broken state corresponding to breaking of rotation axis 24. In particular, the two stop screws 60, 61 are respectively mounted on the two flanges 45, 46 of second girder 14.

The invention claimed is:

1. A device for supporting and guiding a hauling cable of a vehicle transportation installation by cable, comprising:

a sheave configured for supporting and guiding the hauling cable;

a first girder provided with a main axis and two first flanges, the main axis passing through the two first flanges and defining a pivot axis;

a second girder supporting the sheave and mounted pivotally movable around the main axis, the second girder being provided with two second flanges;

at least one recovery element mounted on the first girder and configured to catch hold of the second girder in an abnormal operating state corresponding to failure of the main axis; and at least one cooperating element mounted on the second girder at a distance from said at least one recovery element in a normal operating state where the second girder swivels around the main axis, said at least one cooperating element being configured to be in contact with said at least one recovery element in the abnormal operating state, wherein:

the at least one recovery element and the at least one cooperating element are facing along a vertical axis; and either:

one of the at least one recovery element and the at least one cooperating element is an at least one protruding element arranged protruding from at least one of the two first flanges along a direction parallel to the pivot axis and wherein the other of the at least one recovery element and the at least one cooperating element is a housing formed by at least one of the two second flanges and designed to receive the at least one protruding element; or one of the at least one recovery element and the at least one cooperating element is an at least one protruding element arranged protruding from at least one of the two second flanges along a direction parallel to the pivot axis and wherein the other of the at least one recovery element and the at least one cooperating element is a housing formed by at least one of the two second flanges and designed to receive the at least one protruding element.

2. The device for supporting and guiding according to claim 1, wherein said at least one recovery element and said at least one cooperating element are shaped so as to allow swivelling of the second girder in the abnormal operating state.

3. The device for supporting and guiding according to claim 1, wherein said at least one cooperating element corresponds to a cooperating part mounted salient from the second girder and said at least one recovery element corresponds to a recovery housing formed on the first girder and configured to receive the cooperating part in the abnormal operating state.

4. The device for supporting and guiding according to claim 1, wherein said at least one cooperating element corresponds to a cooperating housing formed on the second girder and said at least one recovery element corresponds to a recovery part mounted salient from the first girder and configured to be inserted in the cooperating housing in the abnormal operating state.

5. The device for supporting and guiding according to claim 1, wherein the second girder is situated between the two first flanges.

6. The device for supporting and guiding according to claim 5, wherein the at least one protruding element is a cylindrical axis fixed to the two second flanges and protruding form opposite sides of the second girder and wherein each of the two first flanges defines a housing designed to receive one of opposite ends of the cylindrical axis when failure of the main axis occurs.

7. The device for supporting and guiding according to claim 5, wherein the protruding element is a cylindrical axis connecting the two first flanges and wherein each of the two second flanges defines a housing designed to receive one of opposite ends of the cylindrical axis when failure of the main axis occurs.

8. The device for supporting and guiding according to claim 5, wherein the at least one cooperating element comprises a cylindrical axis fixed to the two second flanges and protruding form opposite sides of the second girder, the cylindrical axis having a first end protruding from the second girder to form a first protruding element, wherein the at least one cooperating element comprises a first housing protruding from one of the two second flanges opposite the first protruding element;

wherein the at least one recovery element comprises a second housing formed by one of the two first flanges and facing the first protruding element and comprises a second protruding element facing the first housing.

9. The device for supporting and guiding according to claim 1, wherein the two first flanges delimit an inner space between the two first flanges, and the second girder is situated outside the inner space, and wherein the at least one protruding element protrudes from only one first flange or second flange.

10. The device for supporting and guiding according to claim 9, wherein the housing extends toward the protruding element in the direction parallel to the pivot axis.

11. The device for supporting and guiding according to claim 1, wherein the main axis is hollow.

12. The device for supporting and guiding according to claim 1, wherein the second girder is provided with two stop screws and a rotation axis, the sheave is mounted movable in rotation around the rotation axis, and the two stop screws are shaped so as to allow rotation of the sheave around the rotation axis in the normal operating state and to be in contact with the sheave in a broken state corresponding to breaking of the rotation axis.

13. A method for supporting and guiding a hauling cable of a vehicle transportation installation by cable, the installation comprising a sheave configured for supporting and guiding the hauling cable, a first girder provided with a main axis, and a second girder supporting the sheave and mounted pivotally movable around the main axis, the method comprising:

swivelling of the second girder around the main axis in a normal operating state, at least one recovery element being mounted on the first girder and at least one cooperating element being mounted on the second girder at a distance from said at least one recovery element in the normal operating state, and wherein said at least one cooperating element comes into contact with said at least one recovery element in an abnormal operating state corresponding to failure of the main axis.

14. A device for supporting and guiding a hauling cable of a vehicle transportation installation by cable, comprising:

a sheave configured for supporting and guiding the hauling cable;

a first girder provided with a main axis and two first flanges, the main axis passing through the two first flanges and defining a pivot axis;

a second girder supporting the sheave and mounted pivotally movable around the main axis, the second girder being provided with two second flanges; and a rotation axis connecting the sheave to the second girder, the rotation axis passing through the sheave, the sheave rotating around the rotation axis;

wherein the sheave defines a recess around the rotation axis and wherein a pin is fixed to one of the two second flange and inserts into the recess to catch hold the sheave to the second girder when failure of the rotation axis occurs.

15. A device for supporting and guiding a hauling cable of a vehicle transportation installation by cable, comprising:

a sheave configured for supporting and guiding the hauling cable, the sheave defining an annular trench on each side of the sheave;

a rotation axis passing through the sheave, the sheave being mounted rotatable around the rotation axis;

a first girder provided with a main axis and two first flanges, the main axis passing through the two first flanges and defining a pivot axis;

a second girder supporting the sheave and mounted pivotally movable around the main axis, the second girder being mounted rotatable around a rotation axis;

two stop screws mounted on the second girder and configured to catch hold of the sheave in an abnormal operating state corresponding to failure of the main axis, the two stop screws being inside the annular trenches; and the two stop screws being at a distance from said sheave in a normal operating state, said two stop screws being configured to be in contact with said sheave in the abnormal operating state;

wherein each of the two stop screws and the sheave are facing along a vertical axis.

* * * * *